United States Patent [19]

Nikoden, Jr.

[11] 4,247,115

[45] Jan. 27, 1981

[54] SHOOTING BOOTH

[75] Inventor: Joseph Nikoden, Jr., Palatine, Ill.

[73] Assignee: Detroit Bullet Trap Corporation, Schaumburg, Ill.

[21] Appl. No.: 832,745

[22] Filed: Sep. 12, 1977

[51] Int. Cl.[3] ..... A63B 69/00

[52] U.S. Cl. ..... 273/317; 42/94; 108/48

[58] Field of Search ..... 211/64; 248/118; 273/102 R, 102.4; 272/3; 42/94; 89/37 BA; 173/167; 108/48; 52/71

[56] References Cited

U.S. PATENT DOCUMENTS

| | | | |
|---|---|---|---|
| 1,741,323 | 12/1929 | Lufkin | 52/71 |
| 4,057,180 | 11/1977 | Whittaker | 211/64 |

FOREIGN PATENT DOCUMENTS

| | | | |
|---|---|---|---|
| 77850 | 9/1949 | Czechoslovakia | 52/71 |
| 6505394 | 10/1966 | Netherlands | 108/48 |
| 455562 | 10/1936 | United Kingdom | 52/71 |

*Primary Examiner*—Paul E. Shapiro

*Attorney, Agent, or Firm*—Hill, Van Santen, Steadman, Chiara & Simpson

[57] ABSTRACT

A shooting booth for shooting ranges having a target located down-range of the booth, the booth being formed by a pair of spaced side walls with one of the side walls having a cantilever support barricade. The barricade is a narrow vertical panel positioned toward the end of the cantilever arms and spaced from the hinge point at the side walls to form a window between the side wall and the panel. A shelf is mounted at the side wall adjacent to the barricade, and the booth is hinged to fold around the shelf and against the side wall such that the shelf may be lowered to a horizontal position or raised to a vertical position without interference with the barricade.

6 Claims, 5 Drawing Figures

SHOOTING BOOTH

BACKGROUND OF THE INVENTION

1. Description of the Prior Art

Prior art barricades have been mounted on the side wall of a shooting booth and have been pivoted to swing in either direction toward either booth on opposite sides of that side wall. However, this defeats the purpose of the blast shield. Also, such an arrangement produces an interference between users of adjacent booths as they may be competing for the use of the same barricade.

2. Field of the Invention

The field of art to which this invention pertains is shooting booths for shooting ranges, and, in particular, to the orientation of shelves, barricades and blast shields for use at the booth.

SUMMARY OF THE INVENTION

It is an important feature of the present invention to provide an improved booth for a shooting range.

It is another feature of the present invention to provide a booth for a shooting range having a novel arrangement of the shelf, barricade and blast shield.

It is a principal object of the present invention to provide a booth for a shooting range having a barricade which is cantilever mounted on a pair of support arms which are hinged to the target facing edge of a side wall forming the booth.

It is another object of the present invention to provide a shooting booth having a swinging barricade attached to a target facing edge of one of the walls of the booth where the barricade includes a narrow barricade panel spaced from the points of support at the side wall to form a window between the panel and the side wall.

It is another object of the present invention to provide a shooting booth as described above wherein the barricade is capable of being swung in position which encompasses a shelf mounted on the side wall such that the barricade may be positioned flush against the side wall and the shelf may be raised and lowered through the window of the barricade without interference with the barricade itself.

It is a further object of the present invention to provide a shooting booth as described above wherein a blast shield is mounted to the same edge as the barricade and extends in the direction of the target with the shield being located between the points of connection of the support arm to the target facing edge of the side wall.

These and other objects, features and advantages of the present invention will be understood in greater detail from the following description and the associated drawings wherein reference numerals are utilized to designate a preferred embodiment.

DESCRIPTION OF THE PREFERRED EMBODIMENT

The present invention relates to a shooting booth for a shooting range and, in particular, to a booth arrangement including a shelf, shooting barricade and blast shield. The barricade is mounted at a target facing edge of one of the side walls forming the booth and is pivoted between an operating and storage position. The barricade includes a narrow vertical barricade panel which is spaced from the side wall and suspended on the cantilever arms thereby forming a window between the panel and the side wall. This window is then allowed to pass over the shelf as the barricade is moved to its storage position, the shelf being in its raised or vertical position and resting against the side wall.

Figure 1:
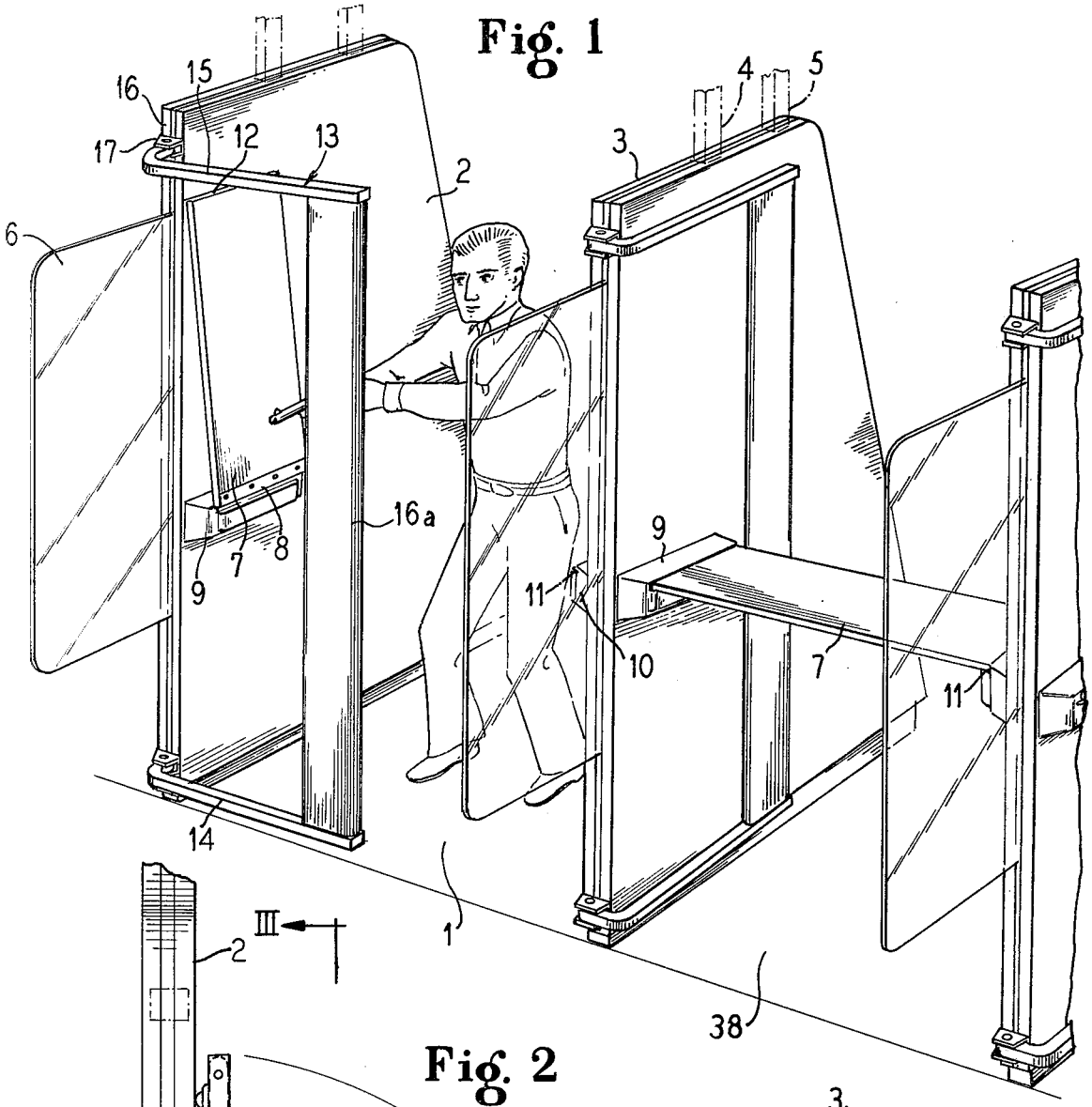
FIG. 1 is a perspective of a number of shooting booths according to the present invention showing a shooter positioned in one booth and functioning with a barricade positioned in front of the shooter and showing the shelf in its raised position.

Referring to the drawings in greater detail, FIG. 1 shows a shooting booth 1 which is formed by a pair of dividers or side walls 2 and 3. The side walls 2 and 3 are spaced apart to form a shooter position therebetween. A shooter is shown positioned in the shooting booth.

The side walls 2 and 3 may be formed of a rigid wall with molded plastic sidings. Regardless, the side walls are firmly affixed to the floor of the booth and also anchored to the ceiling of the shooting room by a pair of steel members 4 and 5 shown in connection with the side wall 3. Each of the side walls has a blast shield 6 associated therewith. The blast shield may be formed of any suitable material such as plexiglass and serves to protect a shooter from the full blast of an adjacent shooter.

A shelf 7 is hinged at 8 to a support 9 which is firmly secured to the side wall 2. Due to the hinge 8, the shelf 7 may be raised to its storage or vertical position as shown in FIG. 1 at the left or may be lowered to its servicing or horizontal position as shown to the right in FIG. 1. The side of the booth opposite from the support 9 has a further support 10 which has a lip 11 for receiving the outboard end 12 of the shelf 7 when it is in its horizontal position.

The shooting booth of FIG. 1 also has a barricade 13 which consists of a pair of cantilever mounted support arms 14 and 15. The arms are spaced apart toward the bottom and top of the side wall 2 to be out of the way of the region of shooting. They are mounted to a target facing edge 16 of a side wall 2. The mounting mechanism is shown more specifically in FIG. 4.

The cantilever arms 13 and 14 support a narrow elongated vertical barricade panel **16*a* which is mounted to the outboard ends of the arms 13 and 14**.

Figure 4:
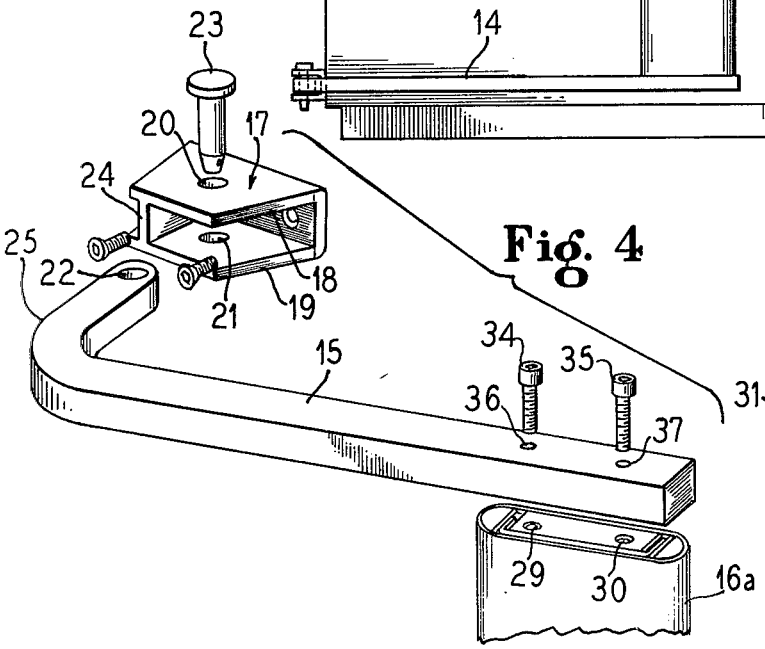
FIG. 4 is an exploded detailed view of the mounting arrangement of one of the cantilever support arms of the barricade.
Figure 5:
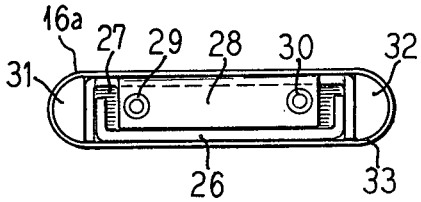
FIG. 5 is a top view of the narrow vertical barricade panel which is mounted to the end of the cantilever support arm of FIG. 4.

Referring to FIG. 4, the upper support arm 13 is shown in more detail. The arm 13 consists of an L-shaped support as further illustrated in FIG. 4. A bracket 17 is mounted directly to the target facing edge 16 of the side wall 2. The bracket 17 has upper and lower flanges 18 and 19 with vertically arranged bores 20 and 21, respectively. The pivotal end of the support arm 13 has a bore 22 which may be aligned with the bores 20 and 21. The bracket is fed between the flanges 18 and 19, and a pin 23 is inserted through the bores 20, 22 and 21 to hold the support arm to the bracket in a pivotal or hinged fashion. A stop 24 is provided between the flanges 18 and 19, and when the support arm 13 is rotated clockwise in FIG. 4, a surface 25 strikes the support 24 and stops further rotation or pivotal movement of the support arm.

The narrow elongated barricade panel 16 may consist of a pair of steel channels 26 and 27. The channel 27 has a folded end 28 which supports a pair of nut inserts 29 and 30. The panel is made more attractive by wood fillers 31 and 32 at the ends thereof, and the entire assembly is encased in an attractive rubber cover 33.

The support arm 13 is attached to the panel 16*a* by means of a pair of bolts 34 and 35 which are inserted through holes 36 and 37 at the outboard end of the arm 13. These bolts are then threaded into the nut inserts 29 and 30 to support the panel. In this way, the panel is mounted between the upper and lowered cantilever arms 13 and 14.

When the barricade 13 is in its service position, it is disposed as shown in FIG. 1, namely perpendicular to the side wall 2. Due to stop 24 (FIG. 4), the barricade cannot be moved further in a direction away from the shooter (clockwise). However, the barricade can be moved toward the shooter and cause it to be stored flush against the side wall 2 as illustrated in connection with the side wall 3 of a booth 38 (FIG. 1).

Figure 2:
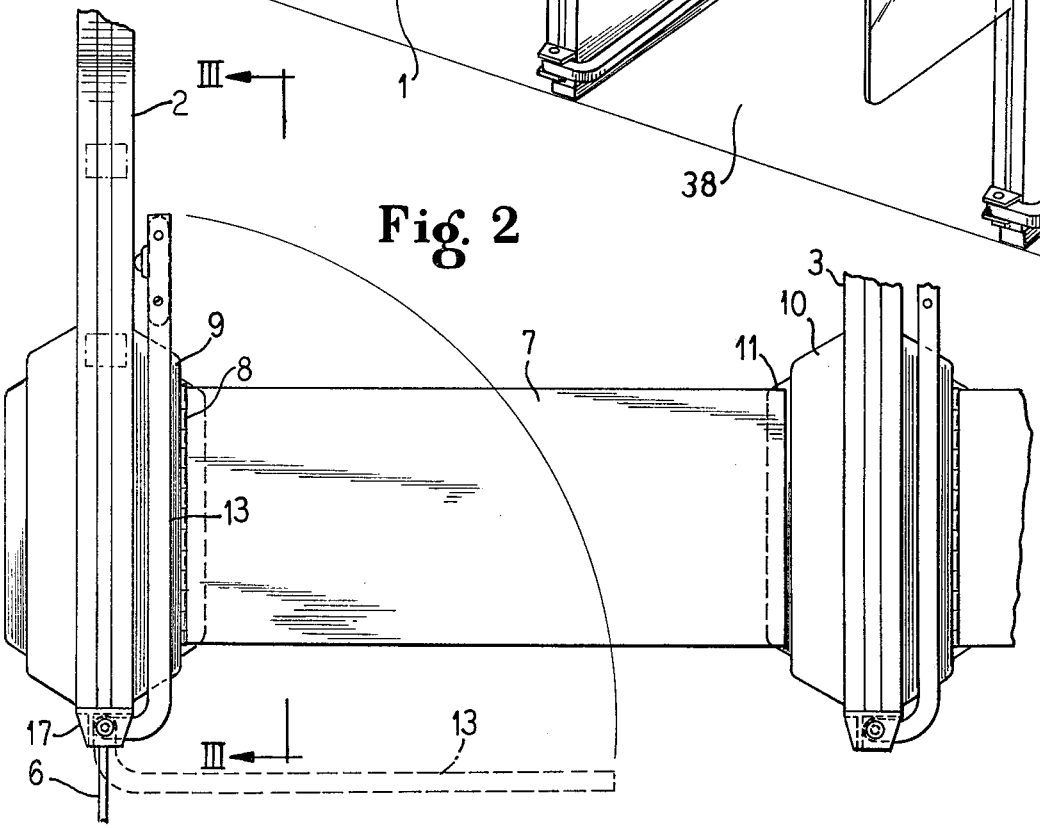
FIG. 2 is a top view of the shooter booth showing the shelf in the lowered position and showing the barricade in the storage position flush against the side wall and also indicating the operating position for the barricade in dash lines.
Figure 3:
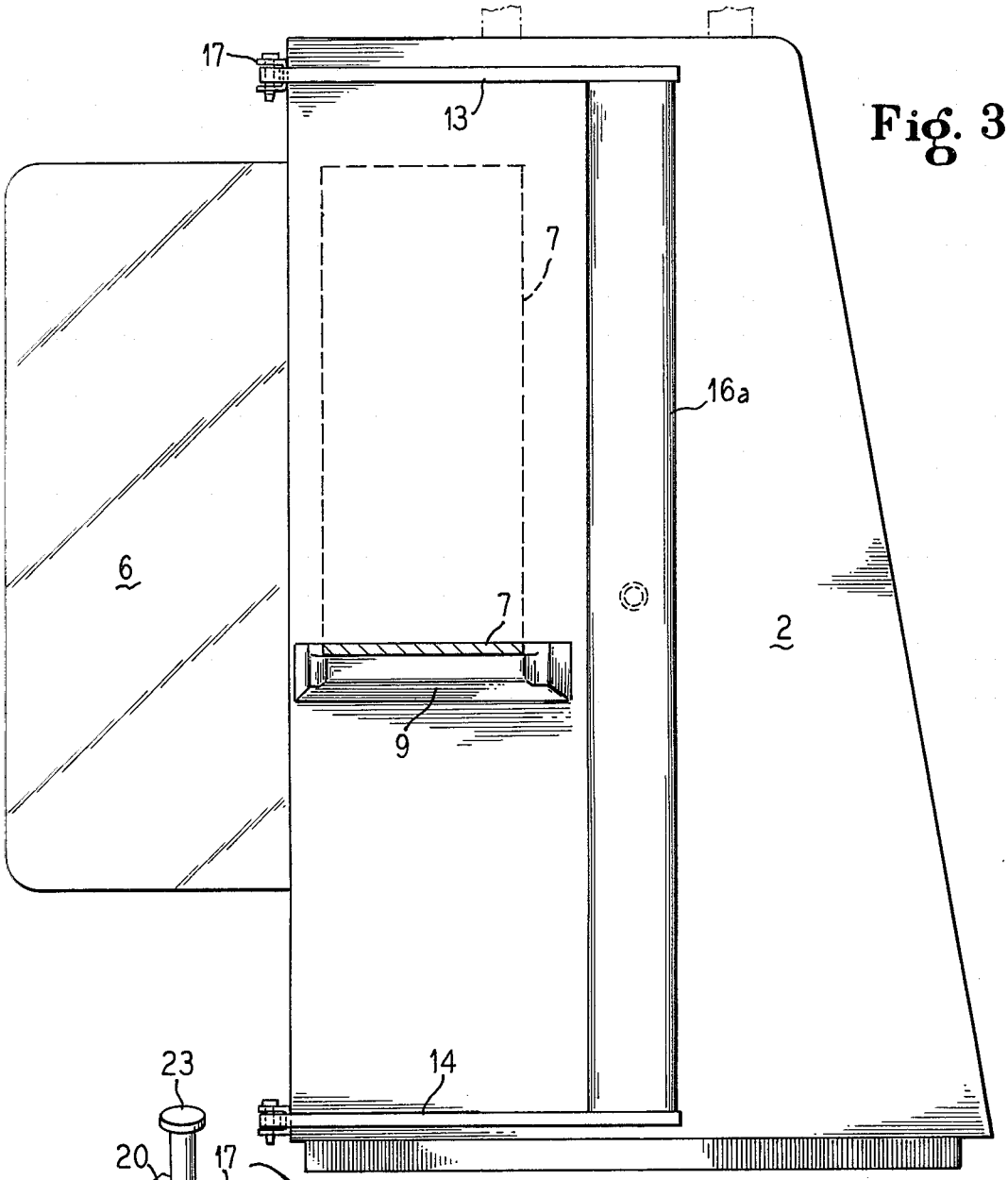
FIG. 3 is a side view of one of the side walls of the shooting booth showing the shelf in its lowered position and the barricade in its stored position and also illustrating the orientation of the blast shield.

With the shelf 7 in its storage position as shown to the left in FIG. 1, the barricade may be moved counterclockwise toward the position shown to the right in FIG. 2. In this case, the window provided between the panel 16*a* and the side wall 2 passes over the shelf 7 without interference. The shelf 7 may then be lowered (as shown to the right in FIG. 1) to its servicing position. The barricade is then conveniently stored against the side wall 3. Also, the barricade in no way interferes with the presence of the blast shield 6. There is no competition between shooters in adjacent booths for the barricade, since each booth is provided with an independent barricade which allows the shooter to shoot from either the right or left edge.

It would be apparent that modifications may be made of this disclosed embodiment without departing from the scope of the invention as set forth in the claims and all such modifications are intended to be contemplated by the present invention.

I claim:

1. A shooter booth for a shooting range having target down-range of the booth comprising:

a pair of side walls defining a shooter space therebetween;

a shelf hinged at one side wall and having a raised vertical position and a lowered horizontal position;

a vertically arranged barricade being mounted at said booth in the vicinity of said shelf;

said barricade including a pair of support arms hinged at one end at points in the vicinity of said shelf and supporting a narrow vertically disposed panel at the other end thereof;

said panel being spaced outwardly from the hinge point of said support arms so as to define a window between the panel and one of the side walls;

said barricade being pivotally movable about said hinges to allow said window to pass over said shelf when disposed in its raised position and thereby stored against said side wall;

said window being of sufficient size to allow said shelf to be moved through said window from its raised to its lowered position while said barricade is disposed against said side wall;

and said barricade being movable about its hinges to a barricade position in front of a shooter using the shooting booth.

2. A shooter booth in accordance with claim 1 wherein said support arms for said barricade are hinged to a target facing edge of said side wall and wherein said shelf is mounted adjacent to said target facing edge, said barricade being swingable to a position which is perpendicular to said side wall and located in front of a shooter and also being swingable to a storage position against said side wall.

3. A shooter booth in accordance with claim 2 wherein said support arms are hinged to said target facing edge of said side wall at points adjacent to the bottom and top of said booth, respectively, and wherein said narrow panel extends between the outer ends of said support arms.

4. A shooter booth for a shooting range having target down-range of the booth comprising:

first and second side walls spaced apart to define a shooter space;

each of the side walls having an exposed target facing edge;

a pair of cantilever support arms hinged to said target facing edge at points above and below the normal shooting space provided by the booth;

a shelf mounted to said side wall adjacent to said edge;

said shelf being hinged to said side wall so as to be lowered into an operating position and raised to a storage position;

a narrow elongated vertically disposed barricade panel mounted between the outermost ends of said support arms and defining thereby a window between said elongated barricade panel and said rear edge of said side wall;

said window being sized so as to be capable of being passed over said shelf when it is in its raised storage position to allow said elongated barricade panel to be moved substantially flush against said side wall; and said shelf being movable to its lowered position through said window while said elongated barricade panel is disposed against said side wall.

5. A shooter boother in accordance with claim 4 wherein a blast shield is mounted to said target facing edge between said hinge points of said cantilever support arms which shield extends from said edge in a direction toward said target.

6. A shooter booth for a shooting range having a target located down-range from said booth comprising:

first and second spaced apart walls defining a shooter position;

said spaced apart walls having a rear edge facing down-range;

a barricade having two vertically spaced apart cantilever support arms each being pivotally attached at one end thereof to a respective stationary pivot point at the shooter booth adjacent to said first wall and a solid barricade member being supported by said arms substantially at their outer ends and horizontally spaced from solid pivot points;

said solid barricade member being an elongated vertical panel extending between the cantilever support arms so as to be positionable in front of a shooter occupying the shooter booth and so as to have both vertical edges thereof usable by the shooter as barricades and defining in part first and second shooter openings on each side of said panel;

means for causing said panel to be rigidly positionable against pivotal movement toward the target when the panel is generally placed at right angles to a line between the shooter position and the target;

said barricade being readily movable by pivoting the same to a storage position where the panel is out of line between the shooter position and the target;

the vertical edge of said panel closest to said pivot points and the first wall defining in part a first shooter opening, the width of said first shooter opening being substantially greater than the width of said panel;

the length of the panel being substantially longer than the width of the first shooter opening, said panel when in said right angle position defining in part a second shooter opening between the outward edge of said panel and the second wall, the width of said second shooter opening being substantially greater than the width of said panel.

* * * * *